US008588657B2

(12) United States Patent
Hayashi et al.

(10) Patent No.: US 8,588,657 B2
(45) Date of Patent: Nov. 19, 2013

(54) DEVELOPING DEVICE AND IMAGE FORMING APPARATUS

(75) Inventors: Shigeki Hayashi, Osaka (JP); Takafumi Nagai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 325 days.

(21) Appl. No.: 13/213,548

(22) Filed: Aug. 19, 2011

(65) Prior Publication Data

US 2012/0051794 A1 Mar. 1, 2012

(30) Foreign Application Priority Data

Aug. 24, 2010 (JP) ..... P2010-187670

(51) Int. Cl.
*G03G 15/08* (2006.01)

(52) U.S. Cl.
USPC ..... 399/256; 399/254

(58) Field of Classification Search
USPC ..... 399/256
See application file for complete search history.

(56) References Cited

U.S. PATENT DOCUMENTS 6,122,472 A * 9/2000 Sako et al. ..... 399/254
6,556,795 B2 * 4/2003 Miyamura et al. ..... 399/30
7,801,466 B2 * 9/2010 Hirose ..... 399/256
2004/0179865 A1 9/2004 Nishiyama
2005/0031381 A1 2/2005 Arimoto

FOREIGN PATENT DOCUMENTS

JP 56070576 A * 6/1981
JP 7-244425 9/1995
JP 07244425 A * 9/1995
JP 2004-045945 2/2004
JP 2004-272017 9/2004
JP 2005-55531 3/2005
JP 2006-162810 6/2006

* cited by examiner

*Primary Examiner* — Clayton E LaBalle
*Assistant Examiner* — Leon W Rhodes, Jr.
(74) *Attorney, Agent, or Firm* — Nixon & Vanderhye, P.C.

(57) ABSTRACT

In a developing device including a developer tank and a developing roller, an internal space of the developer tank is partitioned by a partition into a first conveying path, a second conveying path, a first communication path, and a second communication path. A first developer conveying section that conveys the developer in the developer tank in a first conveying direction X is disposed in the first conveying path. A second developer conveying section that conveys the developer in the developer tank in a second conveying direction Y is disposed in the second conveying path. The first developer conveying section includes a first spiral blade, and a rotation tube.

6 Claims, 13 Drawing Sheets

DEVELOPING DEVICE AND IMAGE FORMING APPARATUS

CROSS-REFERENCE TO RELATED APPLICATION

This application claims priority to Japanese Patent Application No. 2010-187670, which was filed on Aug. 24, 2010, the contents of which are incorporated herein by reference in its entirety.

BACKGROUND OF THE TECHNOLOGY

1. Field of the Technology

The present technology relates to a developing device and an image forming apparatus.

2. Description of the Related Art

Copiers, printers, facsimiles, or the like include an image forming apparatus that forms an image by electrophotography. The electrophotographic image forming apparatus forms an electrostatic latent image on a surface of an image bearing member (photoreceptor) using a charging device and an exposure device, develops the electrostatic latent image by supplying developer using a developing device, transfers the developer image on the photoreceptor to a recording medium such as recording paper using a transfer section, and fixes the developer image onto the recording paper using a fixing device and thereby forms an image.

The developer supplied to the photoreceptor by the developing device is contained in a developer tank provided in the developing device. The developer contained in the developer tank is conveyed to a developing roller provided in the developing device. The developing roller rotates while bearing the developer on a surface thereof, and supplies the developer to the photoreceptor. The developer is charged while being conveyed to the developing roller, and the charged developer is moved from the developing roller to the photoreceptor by electrostatic force between the surface of the photoreceptor and the electrostatic latent image.

In this manner, the developing device develops the electrostatic latent image on the surface of the photoreceptor, and forms the developer image.

In recent years, accompanying the increase in speed and miniaturization of the image forming apparatus, a developing device capable of quickly and sufficiently performing the charging of the developer has been demanded. For example, Japanese Unexamined Patent Publication JP-A 2004-272017 discloses a circulation-type developing device including a developer conveying section that has a first conveying path, a second conveying path, a first communication path, and a second communication path which are formed by a partition provided inside a developer tank, and that conveys the developer in the first conveying path and the second conveying path in directions opposite to each other. The developer conveying section disclosed in JP-A 2004-272017 has a configuration where, to an auger screw type rotation shaft member having a rotation shaft member and a spiral blade spirally wound around the rotation shaft member, a flat plate-like member (fin) parallel with an axial line of the rotation shaft member is provided.

The developer conveying section disclosed in JP-A 2004-272017 conveys the developer by the spiral blade in the axial line direction of the rotation shaft member, and moves the developer by the fin in a peripheral direction of the rotation shaft member, so that it is possible to efficiently charge the developer. However, the developer conveying section disclosed in JP-A 2004-272017 has a problem in that a compressing stress is generated in the developer interposed between the spiral blade and the fin, and the developer is deteriorated. When the developer is deteriorated, it is difficult to form a good image using the image forming apparatus.

SUMMARY OF THE TECHNOLOGY

The technology is made to solve the above-described problem, and an object thereof is to provide a developing device capable of sufficiently charging developer and conveying it while suppressing stress generated in the developer, as well as an image forming apparatus.

The technology provides a developing device comprising:

a developer tank that contains developer, the developer tank including a partition, an internal space of the developer tank being partitioned by the partition into a first conveying path extending along a longitudinal direction of the partition, a second conveying path being opposite to the first conveying path with the partition interposed therebetween, a first communication path through which the first conveying path and the second conveying path communicates with each other on a side of one end in the longitudinal direction of the partition, and a second communication path through which the first conveying path and the second conveying path communicates with each other on a side of the other end in the longitudinal direction of the partition;

a first developer conveying section that is disposed in the first developer conveying path and conveys the developer in the developer tank from the side of the other end toward the side of the one end in the longitudinal direction of the partition, the first developer conveying section including:

- a spiral blade that is spirally wound on a side surface of an imaginary column and conveys the developer by rotation around an axial line of the imaginary column,
- a rotation tube that has a cylindrical shape, surrounds an outer peripheral portion of the spiral blade and rotates together with the spiral blade, the rotation tube having an inflow opening portion through which the developer flows in and which is disposed in a circumferential wall of the rotation tube on the side of the other end in the longitudinal direction of the partition, and an outflow opening portion through which the developer flows out and which is disposed on the side of the one end in the longitudinal direction of the partition, and
- a developer guiding blade that is fixed to an outer circumferential wall of the rotation tube, and guides the developer existing on an external side of the rotation tube to the inflow opening portion by rotation of the rotation tube;

a second developer conveying section that is disposed in the second conveying path and conveys the developer in the developer tank from the side of the one end toward the side of the other end in the longitudinal direction of the partition; and a developing roller that bears the developer and supplies the developer to an image bearing member, the developing roller facing the second conveying path.

A developer tank includes a partition, and an internal space of the developer tank is partitioned by the partition into a first conveying path, a second conveying path, a first communication path, and a second communication path. In the first conveying path, there is provided a first developer conveying section that conveys a developer in the developer tank from a side of the other end in a longitudinal direction of the partition toward the side of one end in the longitudinal direction of the partition. The first developer conveying section includes a spiral blade that is spirally wound on the side surface of the imaginary column, and a rotation tube that surrounds an outer peripheral portion of the spiral blade, the rotation tube having an inflow opening portion through which the developer flows in and which is disposed on the side of the other end in the longitudinal direction of the partition, and an outflow opening portion through which the developer flows out and which is disposed on the side of the one end in the longitudinal direction of the partition.

The spiral blade conveys the developer by rotation around the axial line of the imaginary column. The rotation tube rotates together with the spiral blade. Therefore, the developer in the developer tank flows into the internal side of the rotation tube through the inflow opening portion of the rotation tube on the side of the other end in the longitudinal direction of the partition, is conveyed to the side of the one end in the longitudinal direction of the partition by the spiral blade provided on inside the rotation tube, and flows out to the external side of the rotation tube through the outflow opening portion. At this time, the rotation tube rotates together with the spiral blade, and by the rotation, friction is generated between the developer conveyed by the spiral blade and an inner circumferential wall of the rotation tube, and as a result, the developer is charged. Accordingly, the developing device according to the technology can sufficiently charge the developer and convey it while suppressing stress generated in the developer.

Further, the rotation tube has a cylindrical shape and has an inflow opening portion formed at a circumferential wall of the rotation tube. The first developer conveying section includes a developer guiding blade that is fixed to an outer circumferential wall of the rotation tube and guides the developer existing on the external side of the rotation tube to the inflow opening portion by the rotation of the rotation tube. Therefore, it is possible to smoothly guide the developer to the spiral blade inside the rotation tube, so that it is possible to suppress stress generated in the developer.

Further, it is preferable that the developer tank includes a first conveying path bottom that faces the first conveying path, a first communication path bottom that faces the first communication path, and a second communication path bottom that faces the second communication path, the first conveying path bottom is formed to be inclined so that the side of the one end in the longitudinal direction of the partition is located on a vertically upper side in relation to the side of the other end in the longitudinal direction of the partition, the first communication path bottom is formed to be inclined so that the side of the first conveying path thereof is located on a vertically upper side in relation to the side of the second conveying path thereof, and the second communication path bottom is formed to be inclined so that the side of the second conveying path thereof is located on a vertically upper side in relation to the side of the first conveying path thereof.

The first conveying path bottom is formed to be inclined so that the side of the one end in the longitudinal direction of the partition is located on a vertically upper side in relation to the side of the other end in the longitudinal direction of the partition. Therefore, the developer on the first conveying path bottom tends to move to the side of the other end in the longitudinal direction of the partition due to the effect of gravity. In this manner, it is possible to suppress the retention of the developer between the first developer conveying section and the bottom of the developer tank at an intermediate position in the longitudinal direction of the partition.

Further, the first communication path bottom is formed to be inclined so that the side of the first conveying path thereof is located on a vertically upper side in relation to the side of the second conveying path thereof. Therefore, the developer on the first communication path bottom tends to move to the side of the second conveying path due to the effect of gravity. In this manner, it is possible to suppress the retention of the developer in the first communication path. In addition, the second communication path bottom is formed be inclined so that the side of the second conveying path thereof is located on a vertically upper side ire relation to the side of the first conveying path thereof. Therefore, the developer on the second communication path bottom tends to move to the side of the first conveying path due to the effect of gravity. In this manner, it is possible to suppress the retention of the developer in the second communication path.

As described above, the developing device according to the technology can suppress the retention of the developer in the first conveying path, the first communication path, and the second communication path, sc that it is possible to smoothly convey the developer, and as a result, it is possible to suppress stress generated in the developer.

Further, it is preferable that the first developer conveying section has columnar supporting members at both ends in the longitudinal direction of the spiral blade.

The first developer conveying section has columnar supporting members at both ends in the longitudinal direction of the spiral blade. Therefore, it is possible to drive the first developer conveying section through the supporting member, so that a driving mechanism of the developing device can be simplified.

Further, it is preferable that the developer tank has a first conveying path upstream-side bottom that faces a portion of the first conveying path on the side of the other end in the longitudinal direction of the partition, and a first barrier wall portion that is adjacent to the first conveying path upstream-side bottom on the side of the one end in the longitudinal direction of the partition in relation to the first conveying path upstream-side bottom, and the first barrier wall portion is formed to protrude toward a vertically upper side in relation to the first conveying path upstream-side bottom.

The first barrier wall portion, which is adjacent to the first conveying path upstream-side bottom and protrudes toward a vertically upper side in relation to the first conveying path upstream-side bottom, is formed at the first conveying path upstream-side bottom on a side of the one end in the longitudinal direction of the partition. Therefore, it is possible to suppress the developer from flowing in between the first developer conveying section and the inner wall the developer tank from the side of the other end in the longitudinal direction of the partition.

Further, it is preferable that the developer tank has a first conveying path downstream-side bottom that faces a portion of the first conveying path on the side of the one end in the longitudinal direction of the partition, and a second barrier wall portion that is adjacent to the first conveying path downstream-side bottom on the side of the other end in the longitudinal direction of the partition in relation to the first conveying path downstream-side bottom, and the second barrier wall portion is formed to protrude toward a vertically upper side in relation to the first conveying path downstream-side bottom.

The second barrier wall, which is adjacent to the first conveying path downstream-side bottom and protrudes toward a vertically upper side in relation to the first conveying path downstream-side bottom, is formed at the first conveying path downstream-side bottom on the side of the other end in the longitudinal direction of the partition. Therefore, it is possible to suppress the developer from flowing in between the first developer conveying section and the inner wall of the developer tank from the side of the one end in the longitudinal direction of the partition.

Further, the technology provides an electrophotographic image forming apparatus comprising the developing device described above.

The image forming apparatus comprises the above-described developing device, and due to the developing device, it is possible to sufficiently charge the developer while suppressing stress generated in the developer, and it is possible to a good image that is stable for a long time.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
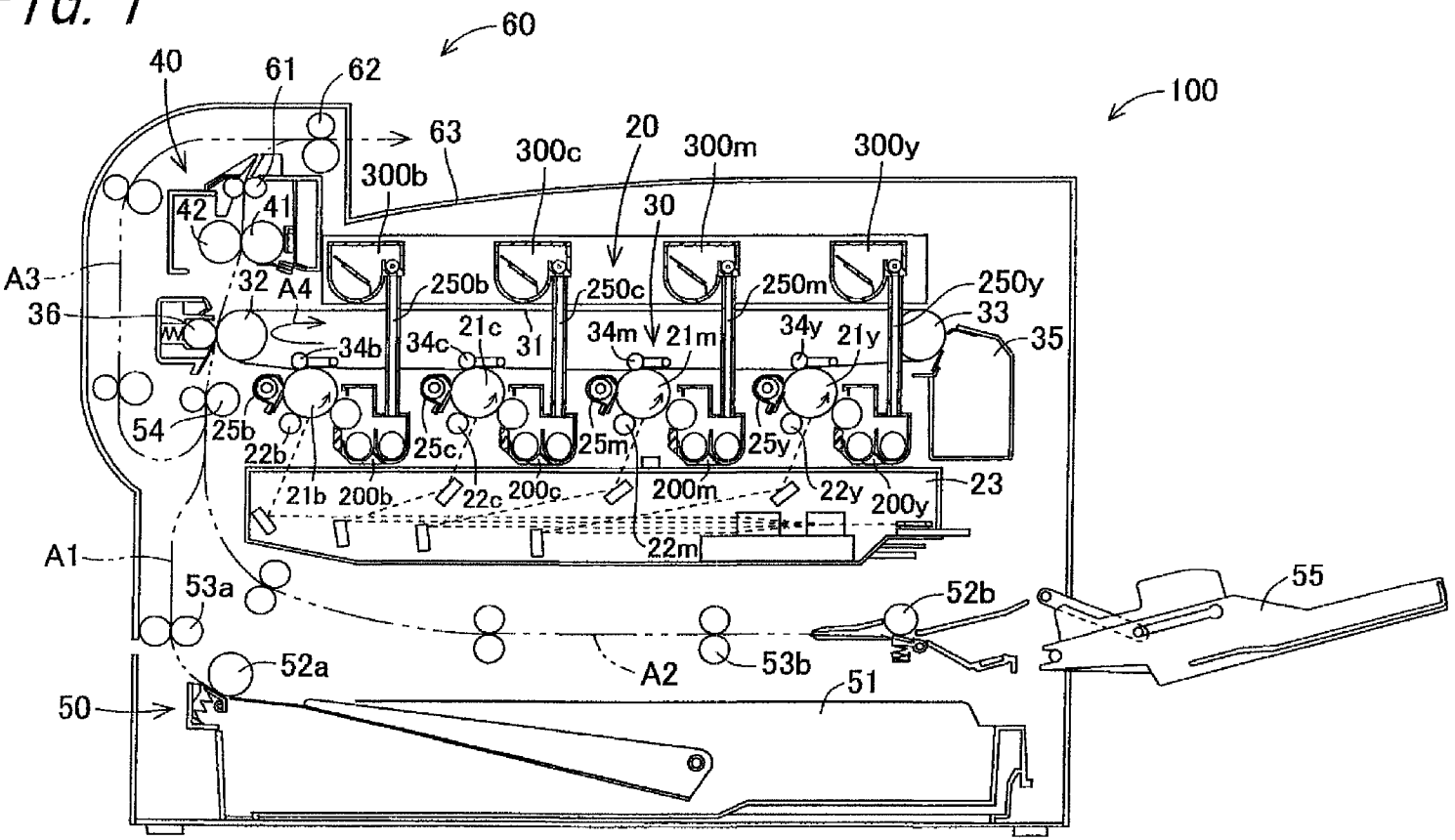
FIG. 1 is a schematic diagram illustrating a configuration of an image forming apparatus.

Now referring to the drawings, preferred embodiments are described below.

First, an image forming apparatus 100 comprising a developing device 200 according to an embodiment will be described. FIG. 1 is a schematic diagram illustrating a configuration of the image forming apparatus 100. The image forming apparatus 100 is a multi-functional peripheral having a copying function, a printing function, and a facsimile function, and forms a full color image or a monochrome image on a recording medium according to transferred image information. The image forming apparatus 100 has three types of printing mode of a copier mode (copying mode), a printer mode, and a facsimile mode, and a printing mode is selected by a control unit section (not shown) according to a manipulation input from a manipulation section (not shown) and the reception of a printing job transmitted from a personal computer, a mobile terminal apparatus, an information recording medium, an external apparatus using a memory device, or the like.

The image forming apparatus 100 includes a toner image forming section 20, a transfer section 30, a fixing section 40, a recording medium feeding section 50, a discharging section 60, and a control unit section (not shown). The toner image forming section 20 includes photoreceptor drums 21*b*, 21*c*, 21*m*, and 21*y*, charging sections 22*b*, 22*c*, 22*m*, and 22*y*, an exposure unit 23, developing devices 200*b*, 200*c*, 200*m*, and 200*y*, cleaning units 25*b*, 25*c*, 25*m*, and 25*y*, toner cartridges 300*b*, 300*c*, 300*m*, and 300*y*, and toner supplying pipes 250*b*, 250*c*, 250*m*, and 250*y*. The transfer section 30 includes an intermediate transfer belt 31, a driving roller 32, a driven roller 33, intermediate transfer rollers 34*b*, 34*c*, 34*m*, and 34*y*, a transfer belt cleaning unit 35, and a transfer roller 36.

The photoreceptor drum 21, the charging section 22, the developing device 200, the cleaning unit 25, the toner cartridge 300, the toner supply pipe 250, and the intermediate transfer roller 34 are disposed for each color to correspond to image information of each color of black (b), cyan (c), magenta (m), and yellow (y) included in color image information. In this specification, in a case where four members corresponding to the colors, respectively, are discriminated, a letter representing each color is attached to the end of a numeral representing each member and this is used as a reference numeral, and in a case where each of the members are collectively referred to, only the numeral representing each of the members is used as a reference numeral.

The photoreceptor drum 21 is supported by a driving unit (not shown) so as to be rotatable around an axial line thereof, and includes a conductive substrate (not shown), and a photoconductive layer formed on a surface of the conductive substrate. The conductive substrate may have various shapes, and for example, a cylindrical shape, a column shape, a thin film sheet shape, or the like may be exemplified. The photoconductive layer is formed of a material showing a conductive property when irradiated with light. As the photoreceptor drum 21, it is possible to use a member including a cylindrical member (conductive substrate) formed of aluminum and a thin film (photoconductive layer) that is formed on an outer circumferential surface of the cylindrical member and is made of, for example, amorphous silicon (a-Si), selenium (Se), or organic photo-semiconductor (OPC).

The charging section 22, the developing device 200, and the cleaning unit 25 are disposed in this order along the rotational direction of the photoreceptor drum 21, and the charging section 22 is disposed on a vertically lower side in relation to the developing device 200 and the cleaning unit 25.

The charging section 22 is a device that charges the surface of the photoreceptor drum 21 at predetermined polarity and potential. The charging section 22 is disposed at a position facing the photoreceptor drum 21 along the longitudinal direction of the photoreceptor drum 21. In the case of contact charging type, the charging section 22 is disposed to come into contact with the surface of the photoreceptor drum 21. In the case of the non-contact charging type, the charging section 22 is disposed to be spaced from the surface of the photoreceptor drum 21.

The photoconductor section 22 is disposed at the periphery of the photoreceptor drum 21 together with the developing device 200 and the cleaning unit 25. It is preferable that the photoconductor section 22 is disposed at a position close to the photoreceptor drum 21 in relation to the developing device 200 and the cleaning unit 25. In this manner, it is possible to reliably prevent occurrence of charging failure of the photoreceptor drum 21.

As the charging section 22, a brush type charging device, a roller type charging device, a corona discharge device, an ion generating device, or the like may be used. The brush type charging device and the roller type charging device are charging devices of contact charging type. In the brush type charging device, a charging brush, a magnetic brush, or the like is usable. The corona discharge device and the ion generating device are charging devices of non-contact charging type. In the corona discharge device, a wire-like discharge electrode, a saw-like discharge electrode, a needle-like discharge electrode, or the like is usable.

The exposure unit 23 is disposed so that light emitted from the exposure unit 23 passes between the charging section 22 and the developing device 200 and the surface of the photoreceptor drum 21 is irradiated with the light. The exposure unit 23 irradiates the surface of each of the photoreceptor drums 21*b*, 21*c*, 21*m*, and 21*y* that are in a charged state with laser light corresponding to image information of each color, respectively, and thereby an electrostatic latent image corresponding to the image information of each color is formed on the surface of each of the photoreceptor drums 21*b*, 21*c*, 21*m*, and 21*y*. As the exposure unit 23, a laser scanning unit (LSU) provided with a laser irradiation section and a plurality of reflective mirrors may be used. As the exposure unit 23, an LED (light emitting diode) array, a unit of suitably combining a liquid crystal shutter and a light source, or the like may be used.

The developing device 200 is a device that develops the electrostatic latent image formed on the photoreceptor drum 21 with a toner, and thereby forms a toner image on the photoreceptor drum 21. A toner supplying pipe 250 that is a cylindrical member is connected to the developing device 200 at a vertically upper part thereof. The details of the developing device 200 will be described later.

The toner cartridge 300 is displaced on a vertically upper side in relation to the developing device 200, and contains an unused toner. The toner supplying pipe 250 is connected to the toner cartridge 300 at a vertically lower part thereof. The toner cartridge 300 supplies the toner to the developing device 200 through the toner supplying pipe 250. The details of the toner cartridge 300 will be described later.

The cleaning unit 25 is a member that removes the toner remaining on the surface of the photoreceptor drum 21 after transferring the toner image onto the intermediate transfer belt 31 from the photoreceptor drum 21 and thereby cleans the surface of the photoreceptor drum 21. As the cleaning unit 25, for example, a plate-like member that scrapes the toner, and a container-like member that recovers the scraped toner are used.

According to the toner image forming section 20, the surface of the photoreceptor drum 21, that is in a uniformly charged state by the charging section 22, is irradiated with laser light corresponding to image information from the exposure unit 23, and thereby an electrostatic latent image is formed thereon. The toner is supplied to the electrostatic latent image on the photoreceptor drum 21 from the developing device 200, and thereby a toner image is formed. The toner image is transferred onto the intermediate transfer belt 31 described later. After the toner image is transferred onto the intermediate transfer belt 31, the toner remaining on the surface of the photoreceptor drum 21 is removed by the cleaning unit 25.

The intermediate transfer belt 31 is an endless belt-like member disposed vertically above the photoreceptor drum 21. The intermediate transfer belt 31 is supported around a driving roller 32 and a driven roller 33 with tension and forms a loop-like pathway, and runs in a direction indicated by an arrow A4.

The driving roller 32 is disposed to be rotatable around a axial line thereof by a driving unit (not shown). The driving roller 32 allows the intermediate transfer belt 31 to run in the direction indicated with the arrow A4 by rotation thereof. The driven roller 33 is provided to be rotatable in accordance with rotation of the driving roller 32, and generates a constant tension to the intermediate transfer belt 31 so that the intermediate transfer belt 31 does not go slack.

The intermediate transfer roller 34 is provided to come into pressure-contact with the photoreceptor drum 21 with the intermediate transfer belt 31 interposed therebetween and to be rotatable around an axial line thereof by a driving unit (not shown). As the intermediate transfer roller 34, for example, a roller member including a conductive elastic member on a surface of a metal (for example, stainless steel) roller having a diameter of 8 to 10 mm may be used. The intermediate transfer roller 34 is connected to a power source (not shown) that applies a transfer bias voltage and has a function of transferring the toner image formed on the surface of the photoreceptor drum 21 to the intermediate transfer belt 31.

The transfer roller 36 is provided to come into pressure-contact with the driving roller 32 with the intermediate transfer belt 31 interposed therebetween, and to be rotatable around an axial line thereof by a driving unit (not shown). At a pressure-contact portion (transfer nip region) between the transfer roller 36 and the driving roller 32, the toner image borne on and conveyed by the intermediate transfer belt 31 is transferred onto a recording medium fed from the recording medium feeding section 50 described later.

The transfer belt cleaning unit 35 is provided to be opposite to the driven roller 33 in relation to the intermediate transfer belt 31, and to come into contact with a toner bearing surface of the intermediate transfer belt 31. The transfer belt cleaning unit 35 is provided to remove the toner on the surface of the intermediate transfer belt 31 and recovers the removed toner after the transfer of the toner image onto the recording medium. When the toner remains attached to the intermediate transfer belt 31 after the transferring of the toner image onto the recording medium, there is a problem that the remaining toner is attached to the transfer roller 36 when the intermediate transfer belt 31 runs. When the toner is attached to the transfer roller 36, the toner may contaminate the rear surface of the next recording medium onto which the transferring is to be performed.

According to the transfer section 30, when the intermediate transfer belt 31 runs while being brought into contact with the photoreceptor drum 21, a transfer bias voltage with a polarity opposite to the charging polarity of the toner on the surface of the photoreceptor drum 21 is applied to the intermediate transfer roller 34, and the toner image formed on the surface of the photoreceptor drum 21 is transferred onto the intermediate transfer belt 31. The toner images of the respective colors formed by the photoreceptor drum 21*y*, the photoreceptor drum 21*m*, the photoreceptor drum 21*c*, and the photoreceptor drum 21*b* are sequentially overlaid and transferred onto the intermediate transfer belt 31 in this order and thereby a full color toner image is formed. The toner image transferred onto the intermediate transfer belt 31 is conveyed to the transfer nip region by running of the intermediate transfer belt 31 and is transferred onto a recording medium at the transfer nip region. The recording medium having the toner image transferred thereto is conveyed to the fixing section 40 described later.

The recording medium feeding section 50 includes a paper feed box 51, pick-up rollers 52*a* and 52*b*, conveying rollers 53*a* and 53*b*, registration rollers 54, and a paper feed tray 55. The paper feed box 51 is a container-like member that is provided at a vertically lower part of the image forming apparatus 100 and stores recording mediums at the inside of the image forming apparatus 100. The paper feed tray 55 is a tray-like member that is provided in a side wall surface of the image forming apparatus 100 and stores recording mediums at the outside of the image forming apparatus 100. Examples of the recording medium include regular paper, a sheet for color copying, a sheet for an overhead projector, and a postcard.

The pick-up roller 52*a* is a member that takes out the recording mediums stored in the paper feed box 51 one by one and feeds it to a paper conveyance path A1. The conveying rollers 53*a* are a pair of roller-like members, which are provided to come into pressure-contact with each other, and convey the recording medium in the paper conveyance path A1 toward the registration rollers 54. The pick-up roller 52*b* is a member that takes out the recording mediums stored in the paper feed tray 55 one by one and feeds it to a paper conveyance path A2. The conveying rollers 53*b* are a pair of roller-like members, which are provided to come into pressure-contact with each other, and convey the recording medium in the paper conveyance path A2 toward the registration rollers 54.

The registration rollers 54 are a pair of roller-like members, which are provided to come into pressure-contact with each other, and feeds the recording medium fed from the conveying rollers 53*a* or 53*b* to the transfer nip region in synchronization with conveyance of the toner image borne on the intermediate transfer belt 31 to the transfer nip region.

According to the recording medium feeding section 50, in synchronization with conveyance of the toner image borne on the intermediate transfer belt 31 to the transfer nip region, the recording medium is fed to the transfer nip region from the paper feed box 51 or the paper feed tray 55 and then the toner image is transferred onto the recording medium.

The fixing section 40 includes a heating roller 41 and a pressure roller 42. The heating roller 41 is controlled to maintain a predetermined fixing temperature. The pressure roller 42 is a roller that comes into pressure-contact with the heating roller 41. The heating roller 41 nips the recording medium together with the pressure roller 42 while heating the recording medium, and melts toner constituting the toner image and fixes it onto the recording medium. The recording medium having the toner image fixed thereon is conveyed to the discharge section 60 described later.

The discharge section 60 includes conveying rollers 61, discharge rollers 62, and a catch tray 63. The conveying rollers 61 are a pair of roller-like members, which are provided to come into pressure-contact with each other on a vertically upper side of the fixing section 40. The conveying rollers 61 convey the recording medium having an image fixed thereon toward the discharge rollers 62.

The discharge rollers 62 are a pair of roller-like members, which are provided to come into pressure-contact with each other. In the case of one-sided printing, the discharge rollers 62 discharge the recording medium on which the one-sided printing is completed to the catch tray 63. In the case of double-sided printing, the discharge rollers 62 convey the recording medium on which the one-sided printing is completed to the registration rollers 54 through a paper conveyance path A3 and discharges the recording medium on which the double-sided printing is completed to the catch tray 63. The catch tray 63 is provided in the vertically top surface of the image forming apparatus 100 and stores the recording mediums having the image fixed thereon.

The image forming apparatus 100 includes the control unit section (not shown). The control unit section is provided in the vertically upper part of the internal space of the image forming apparatus 100 and includes a memory portion, a computing portion, and a control portion. To the memory portion, various setting values mediated through an operation panel (not shown) disposed on the vertically upper surface of the image forming apparatus 100, the results detected by sensors (not shown) disposed in various portions inside the image forming apparatus 100, image information from an external device and the like are inputted. Moreover, programs for executing various processes are written in the memory portion. Examples of the various processes include a recording medium determination process, an attachment amount control process, and a fixing condition control process.

As for the memory portion, memories customarily used in this technical field can be used, and examples thereof include a read-only memory (ROM), a random-access memory (RAM), and a hard disc drive (HDD). As for the external device, electrical and electronic devices which can form or obtain the image information and which can be electrically connected to the image forming apparatus 100 can be used. Examples thereof include computers, digital cameras, televisions, video recorders, DVD (Digital Versatile Disc) recorders, HDDVD (High-Definition Digital Versatile Disc) recorders, Blu-ray disc recorders, facsimile machines, and mobile terminal devices.

The computing portion takes out various kinds of data (for example, image formation commands, detection results, and image information) written in the memory portion and the programs for various processes and then makes various determinations. The control portion sends a control signal to the respective devices provided in the image forming apparatus 100 in accordance with the determination result by the computing portion, thus performing control on operations.

The control portion and the computing portion include a processing circuit which is realized by a microcomputer, a microprocessor, and the like having a central processing unit (CPU). The control unit section includes a main power source as well as the processing circuit. The power source supplies electricity to not only the control unit section but also to respective devices provided in the image forming apparatus 100.

Figure 2:
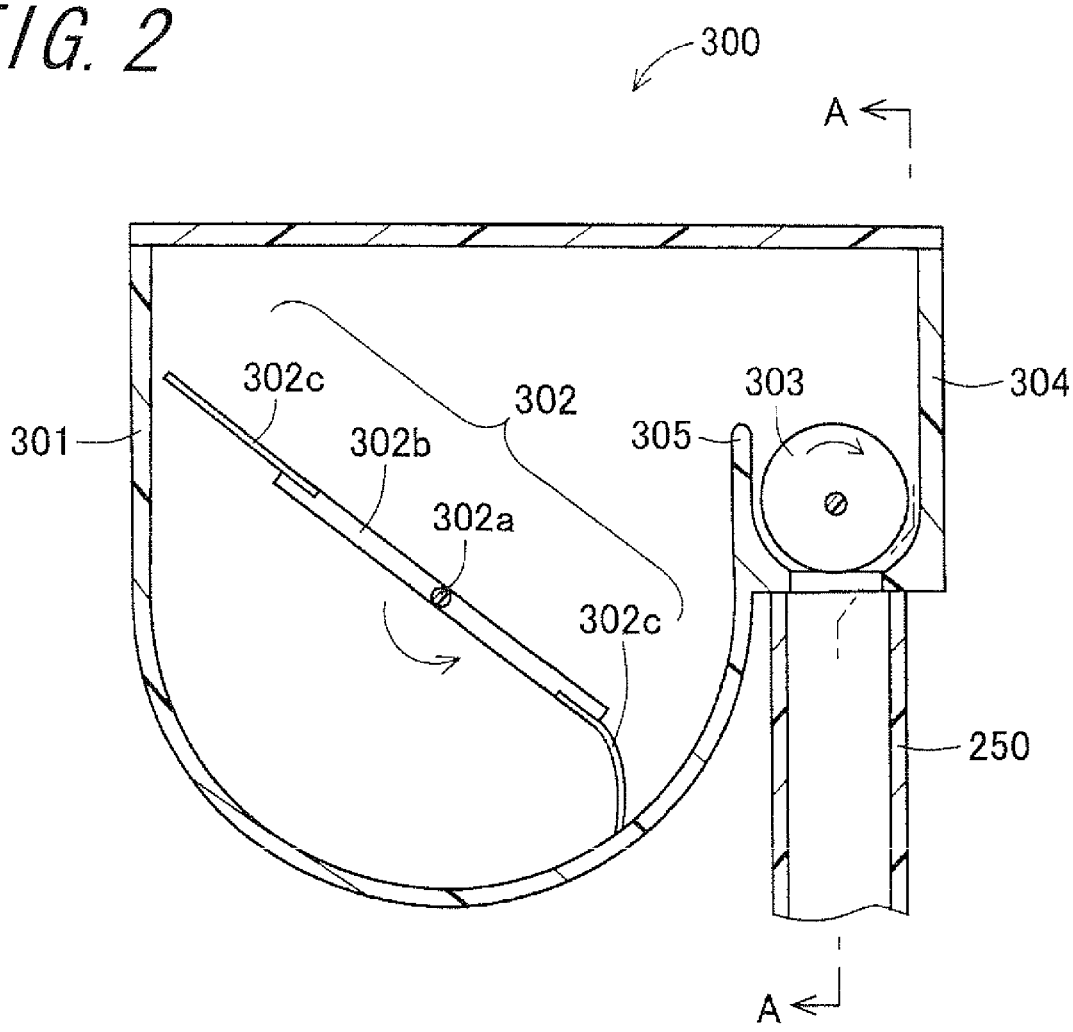
FIG. 2 is a schematic diagram illustrating a configuration of a toner cartridge.
Figure 3:
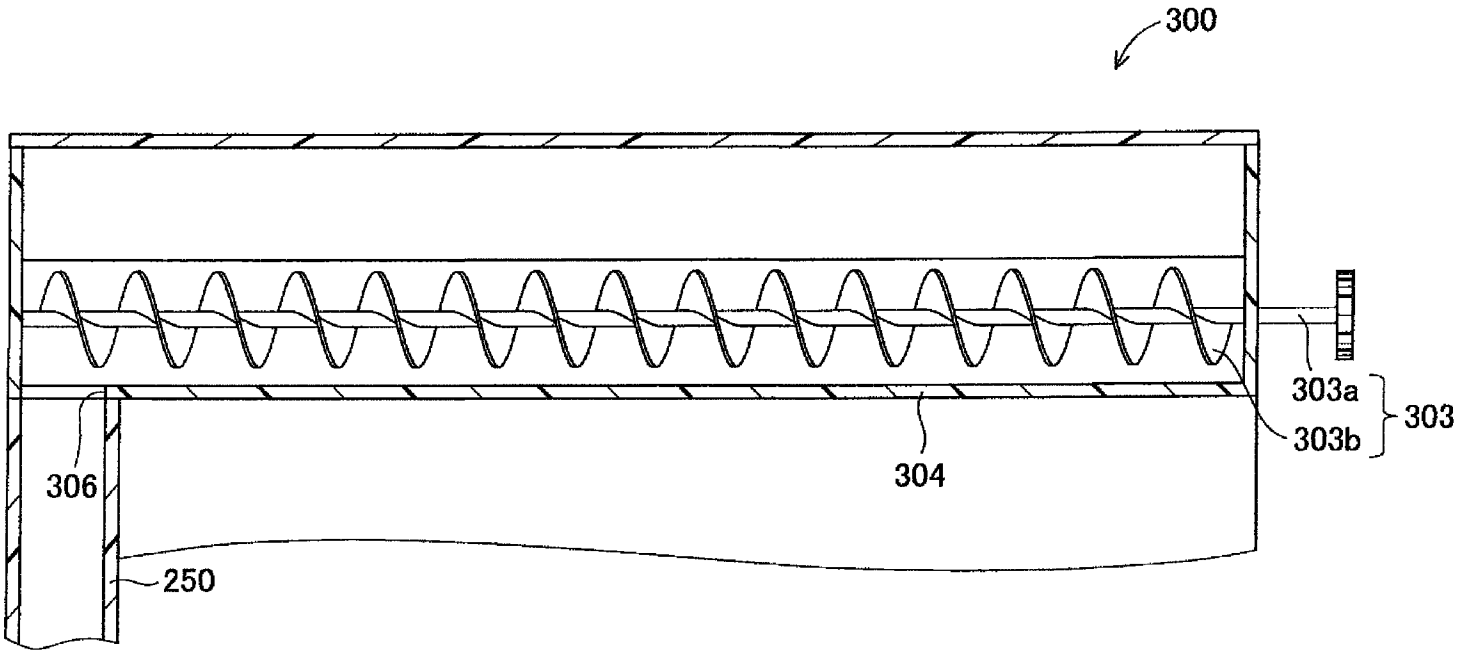
FIG. 3 is a cross-sectional view of toner cartridge taken along the line A-A shown in FIG. 2.

FIG. 2 is a schematic diagram illustrating a configuration of the toner cartridge 300. FIG. 3 is a cross-sectional view of the toner cartridge 300 taken along the line A-A shown in FIG. 2. The toner cartridge 300 is a device that supplies a toner to the developing device 200 through the toner supply pipe 250. The toner cartridge 300 includes a toner container 301, a toner scooping member 302, a toner discharge member 303 and a toner discharge container 304.

The toner container 301 is a container-like member having an approximately semicircular columnar internal space, and in the internal space, supports the toner scooping member 302 so as to freely rotate and contains an unused toner. The toner discharge container 304 is a container-like member having an approximately semicircular columnar internal space provided along a longitudinal direction of the toner container 301, and in the internal space, supports the toner discharge member 303 so as to freely rotate. The internal space of the toner container 301 and the internal space of the toner discharge container 304 communicate with each other through a communicating opening 305 formed along the longitudinal direction of the toner container 301. The toner discharge container 304 has a discharge port 306 formed on a vertically lower part thereof. To the discharge port 306 of the toner discharge container 304, the toner supply pipe 250 is connected.

The toner scooping member 302 includes a rotation shaft 302*a*, a base member 302*b* and a sliding section 302*c*. The rotation shaft 302*a* is a column-shaped member extending along a longitudinal direction of the toner container 301. The base member 302*b* is a plate-like member extending along the longitudinal direction of the toner container 301, and attached to the rotation shaft 302*a* at a center in a width direction and a thickness direction thereof. The sliding section 302*c* is a member having flexibility and attached to both end parts in the width direction of the base member 302*b*, and is formed of, for example, a polyethylene terephthalate (PET). The toner scooping member 302 scoops the toner inside the toner container 301 into the toner discharge container 304 by which the base member 302*b* performs rotation motion following rotation of the rotation shaft 302*a* around the axial line thereof, whereby the sliding section 302*c* provided at the both end parts in the width direction of the base member 302*b* slides on an inner wall face of the toner container 301.

The toner discharge member 303 is a member that conveys the toner inside the toner discharge container 304 toward the discharge port 306. The toner discharge member 303 is a so-called auger screw including a toner discharge rotation shaft 303*a*, and a toner discharge blade 303*b* provided around the toner discharge rotation shaft 303*a*.

According to the toner cartridge 300, an unused toner in the toner container 301 is scooped into the toner discharge container 304 by the toner scooping member 302. Then, the toner scooped by the toner discharge container 304 is conveyed to the discharge port 306 by the toner discharge member 303. The toner conveyed to the discharge port 306 is discharged from the discharge port 306 to the outside of the toner discharge container 304, and supplied to the developing device 200 through the toner supply pipe 250.

Figure 4:
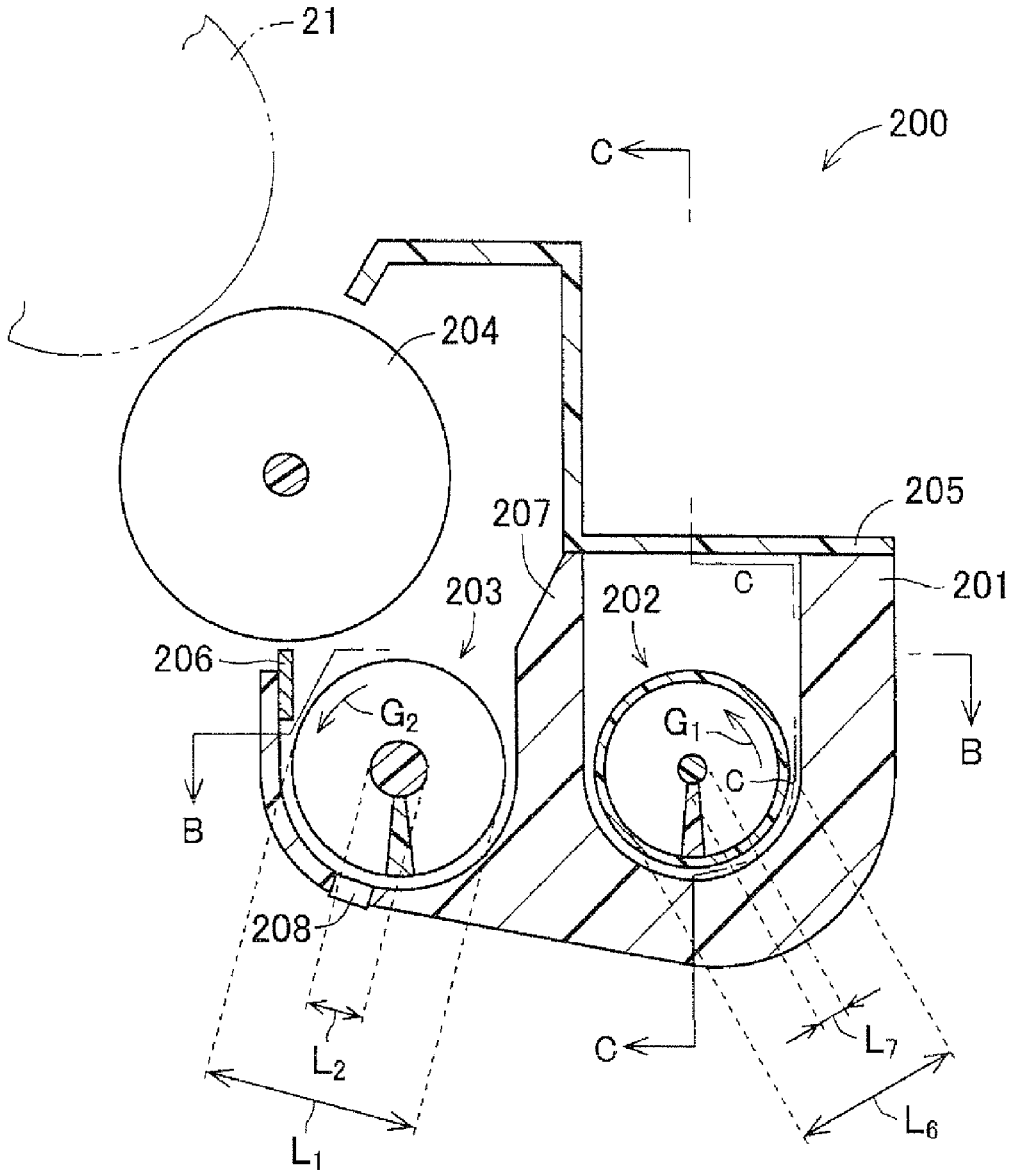
FIG. 4 is a schematic diagram illustrating a configuration of a developing device.
Figure 5:
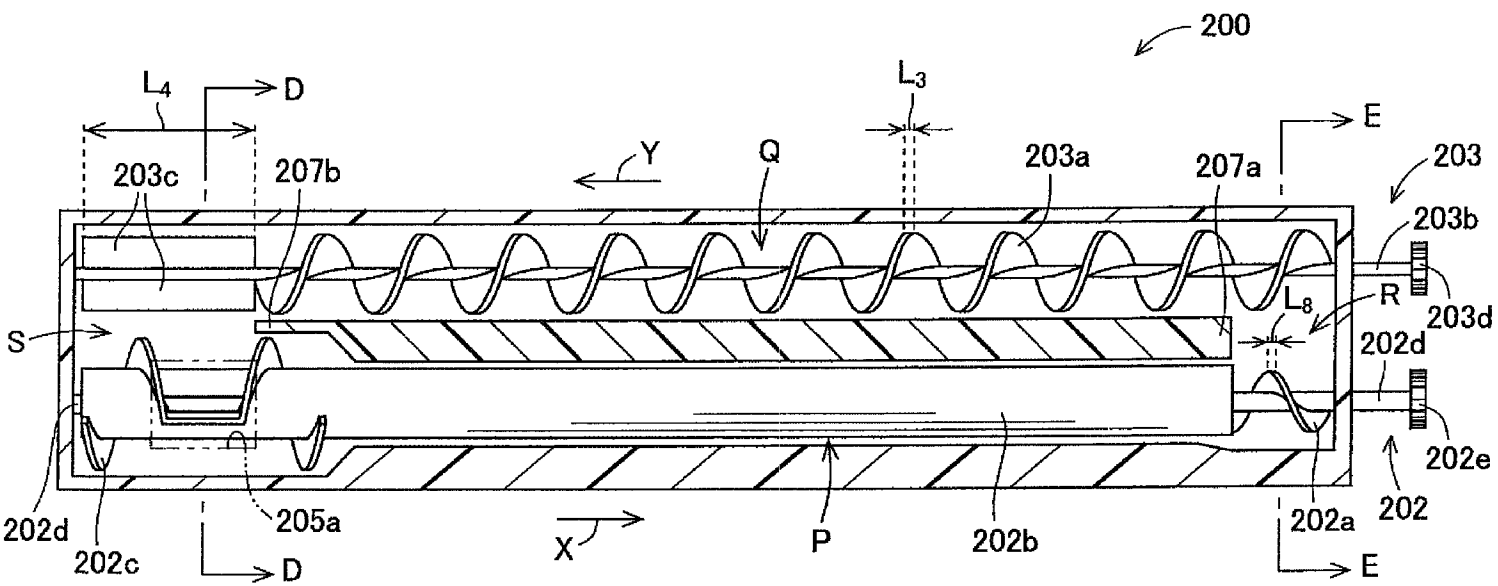
FIG. 5 is a cross-sectional view of the developing device taken along the line B-B shown in FIG. 1.
Figure 6:
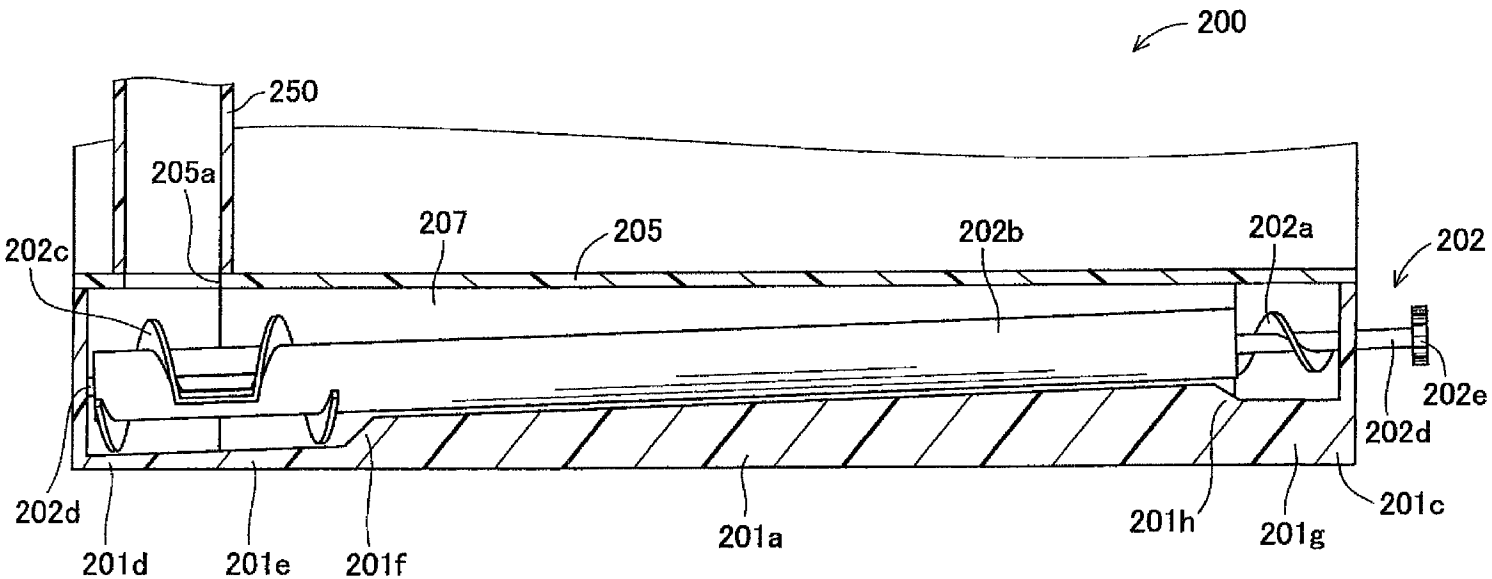
FIG. 6 is a cross-sectional view of the developing device taken along the line C-C shown in FIG. 4.
Figure 7:
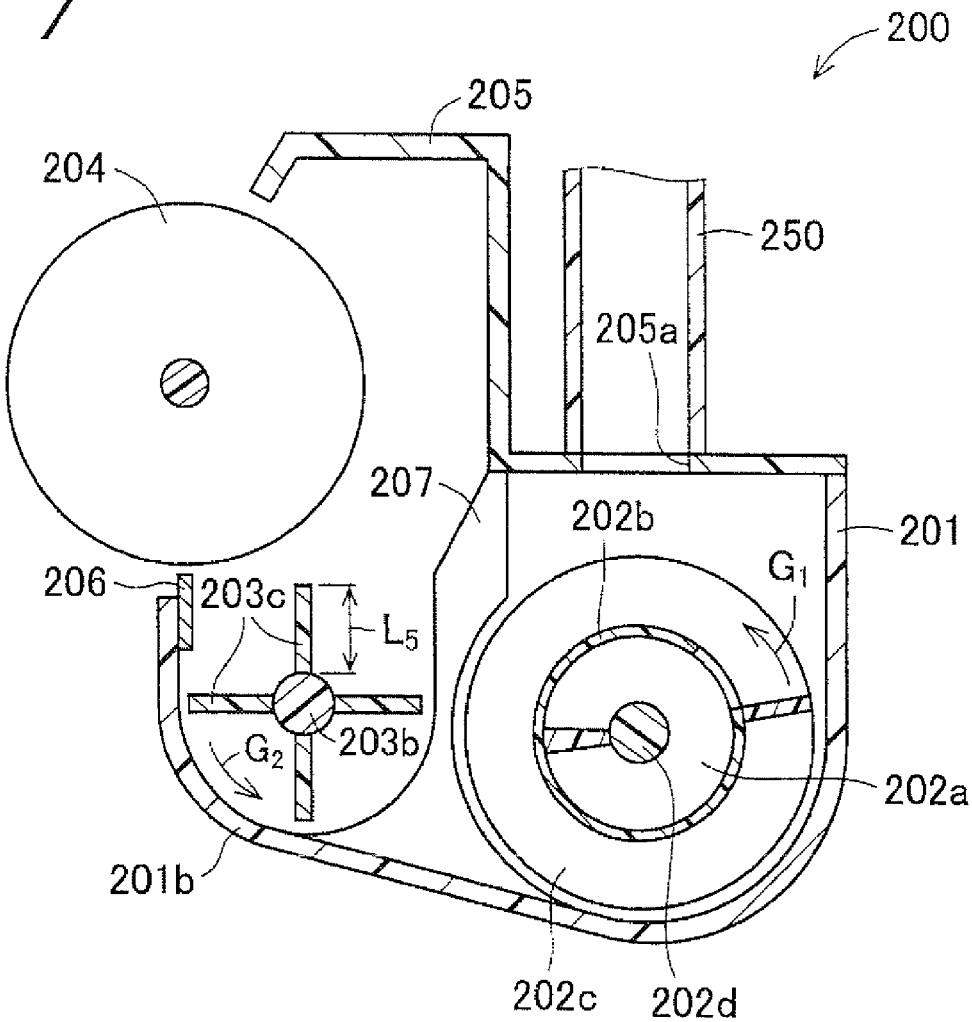
FIG. 7 is a cross-sectional view of the developing device taken along the line D-D shown in FIG. 5.
Figure 8:
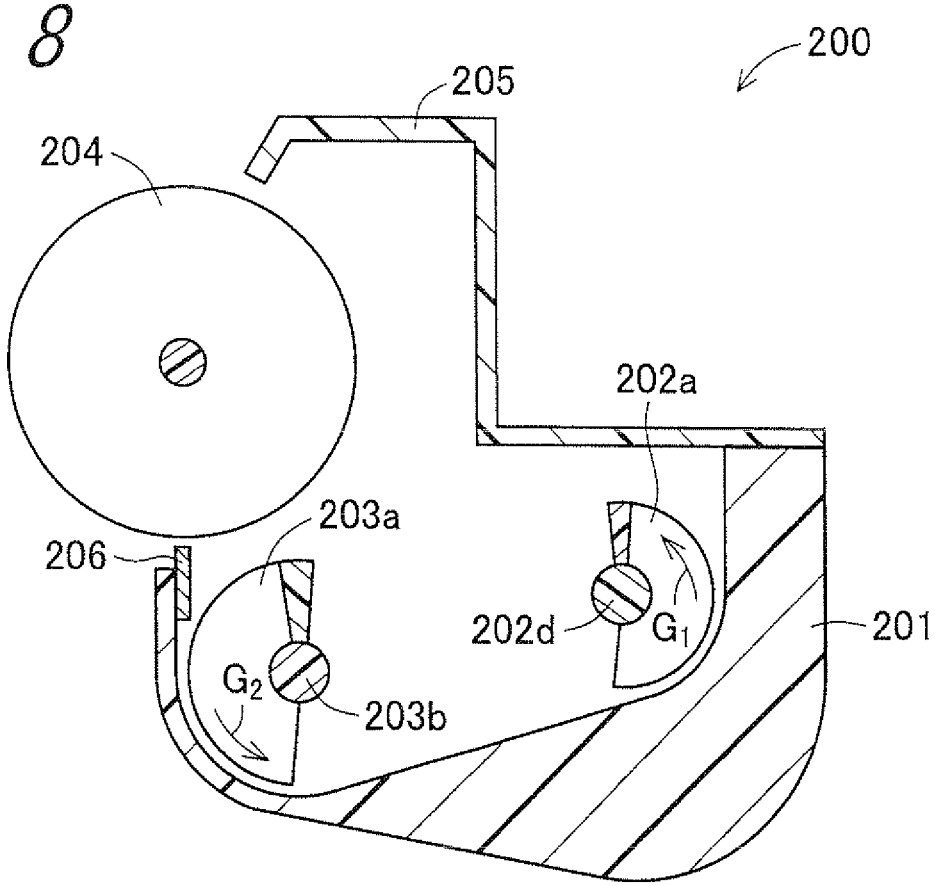
FIG. 8 is a cross-sectional view of the developing device taken along the line E-E shown in FIG. 5.

FIG. 4 is a schematic diagram illustrating a configuration of the developing device 200. FIG. 5 is a cross-sectional view of the developing device 200 taken along the line B-B shown in FIG. 4. FIG. 6 is a cross-sectional view of the developing device 200 taken along the line C-C shown in FIG. 4. FIG. 7 is a cross-sectional view of the developing device 200 taken along the line B-D shown in FIG. 5. FIG. 8 is a cross-sectional view of the developing device 200 taken along the line E-E shown in FIG. 5. The developing device 200 is a device which supplies a toner onto a surface of the photoreceptor drum 21 so as to develop an electrostatic latent image formed on the surface thereof. The developing device 200 includes a developer tank 201, a first developer conveying member 202, a second developer conveying member 203, a developing roller 204, a developer tank cover 205, a doctor blade 206, a partition 207 and a toner concentration detection sensor 208.

The developer tank 201 is a member having an internal space, and contains a developer in the internal space. The developer used in this embodiment may be a one-component developer composed only of a toner, or may be a two-component developer containing a toner and a carrier. In the developer tank 201, there are provided the developer tank cover 205 is provided on the vertically upper side thereof, and in the internal space, the first developer conveying member 202, the second developer conveying member 203, the developing roller 204, the doctor blade 206, and the partition 207. In addition, the toner concentration detection sensor 208 is provided at a vertically lower part (the bottom) of the developer tank 201.

The developing roller 204 includes a magnet roller, and bears the developer inside the developer tank 201 on a surface thereof and supplies the toner contained in the borne developer to the photoreceptor drum 21. To the developing roller 204, a power source (not shown) is connected and a developing bias voltage is applied. The toner borne on the developing roller 204 is, in the vicinity of the photoreceptor drum 21, moved to the photoreceptor drum 21 with an electrostatic force by the developing bias voltage.

The doctor blade 206 is a plate-like member extending in an axial line direction of the developing roller 204, and is provided so that one end in a width direction thereof is fixed to the developer tank 201, and another end thereof has a clearance with respect to the surface of the developing roller 204. The doctor blade 206 is provided so as to have a clearance with respect to the surface of the developing roller 204, and an amount of developer borne on the developing roller 204 is thereby regulated to a predetermined amount. As a material of the doctor blade 206, stainless steel, aluminum, a synthetic resin, or the like is usable.

The partition 207 is a member having a longitudinal shape extending along the longitudinal direction of the developer tank 201 at the substantially center portion of the developer tank 201. The vertically upper part of the partition 207 is formed to be inclined with respect to the vertical direction so that the upper portion is made to be thin to prevent the retention of the developer. The partition 207 is provided between the bottom of the developer tank 201 and the developer tank cover 205 so that both longitudinal ends are spaced from an inner wall surface of the developer tank 201. Due to the partition 207, the internal space of the developer tank 201 is partitioned into a first conveying path P, a second conveying path Q, a first communication path R, and a second communication path S.

The second conveying path Q is a space that extends along the longitudinal direction of the partition 207 and faces the developing roller 204. The first conveying path P is a space that extends along the longitudinal direction of the partition 207 and faces the second conveying path Q with the partition 207 interposed therebetween. The first communication path R is a space communicating with the first and second conveying paths P anal Q on a side of one end 207*a* in the longitudinal direction of the partition 207. The second communication path S is a space communicating with the first and second conveying paths P and Q on a side of the other end 207*b* in the longitudinal direction of the partition 207.

The developer tank cover 205 is detachably provided on a vertically upper side of the developer tank 201. In the developer tank cover 205, a supply port 205*a* is formed. The supply port 205*a* is formed at a position facing the second communicating path S vertically above the first conveyance path P. To the developer tank cover 205, at the supply port 205*a*, the toner supply pipe 250 is connected. The toner contained in the toner cartridge 300 is supplied into the developer tank 201 through the toner supply pipe 250 and the supply port 205*a*.

The first developer conveying section 202 is provided inside the first conveying path P. The first developer conveying section 202 conveys the developer inside the developer tank 201 toward the side of the one end 207*a* of the partition 207 in the longitudinal direction from the side of the other end 207*b* in the longitudinal direction of the partition 207. Hereinafter, a conveying direction of the developer by the first developer conveying section 202 is referred to as a first conveying direction X.

The first developer conveying section 202 includes a first spiral blade 202*a*, a rotation tube 202*b*, a developer guiding blade 202*c*, supporting members 202*d*, and a first gear 202*e*. The first spiral blade 202*a* extends in the longitudinal direction of the partition 207, and is supported by the two columnar supporting members 202*d* at both ends in the longitudinal direction thereof. Among the two supporting members 202*d*, the supporting member 202*d* of the second communication path S side is rotatably supported on the inner wall of the developer tank 201. Among the two supporting members

202*d*, the supporting member 202*d* of the first communication path R side is connected to the first gear 202*e* at the outside of the developer tank 201.

The first spiral blade 202*a* has a shape that is spirally wound on a side surface of an imaginary column, and rotates around an axial line of the imaginary column in a rotational direction $G_1$ at 60 to 180 rpm by a driving unit such as a motor via the supporting member 202*d* and the first gear 202*e*. The developer stored in the first conveying path P is conveyed to a downstream side in the first conveying direction X by rotation of the first spiral blade 202*a*. As described above, the supply port 205*a* of the developer tank cover 205 is formed in the vicinity of the second communication path S on the vertically upper side of the first conveying path P, so that the unused toner inside the toner cartridge 300 is first supplied to the upstream side in the first conveying direction X of the first conveying path P, and then is conveyed to the downstream side in the first conveying direction X by the first developer conveying section 202.

The second developer conveying section 203 is provided inside the second conveying path Q. The second developer conveying section 203 conveys the developer inside the developer tank 201 from the side of the one end 207*a* to the side of the other end 207*b* in the longitudinal direction of the partition 207. Hereinafter, a conveying direction of the developer by the second developer conveying section 203 is referred to as a second conveying direction Y.

The second developer conveying section 203 includes a second spiral blade 203*a*, a rotation shaft member 203*b*, four circumferential rotation plates 203*c*, and a second gear 203*d*. The rotation shaft member 203*b* is a column-shaped member extending along the longitudinal direction of the partition 207, in which one end thereof in the longitudinal direction of the partition 207 is connected to the second gear 203*d* at the outside of the developer tank 201 and the other end thereof in the longitudinal direction of the partition is rotatably supported on the inner wall of the developer tank 201.

The second spiral blade 203*a* has a shape that is spirally wound on a side surface of the rotation shaft member 203*b*, and rotates around an axial line of the rotation shaft member 203*b* in a rotational direction $G_2$ at 60 to 180 rpm by a driving unit such as a motor via the rotation shaft member 203*b* and the second gear 203*d*. The developer stored in the second conveying path Q is conveyed to a downstream side in the second conveying direction Y by rotation of the second spiral blade 203*a*.

The four circumferential rotation plates 203*c* are made of rectangular flat plates having substantially the same shape, and long sides of the respective plates are fixed to the rotation shaft member 203*b*. The four circumferential rotation plates 203*c* are fixed to the rotation shaft member 203*b* so that main surfaces of two adjacent circumferential rotation plates 203*c* are orthogonal to each other, and rotate together with the second spiral blade 203*a* in the rotational direction $G_2$. The developer conveyed from the upstream side in the second conveying direction Y is pushed toward the second communication path S side by rotation motion of the circumferential rotation plates 203*c* and is transferred to the first conveying path P. In addition, in another embodiment, the second developer conveying section 203 may be formed of an auger screw-like member not having the circumferential rotation plates 203*c*.

A value of two times a distance from the axial line of the rotation shaft member 203*b* to a point, which is farthest from the axial line, on the second spiral blade 203*a* is referred to as an outer diameter $L_1$ of the second spiral blade 203*a*. In addition, a value of two times a distance from the axial line of the rotation shaft member 203*b* to a point, which is nearest to the axial line, on the second spiral blade 203*a* is referred to as an inner diameter $L_2$ of the second spiral blade 203*a*. The outer diameter $L_1$ of the second spiral blade 203*a* is appropriately set to within a range of 20 mm or more and 40 mm or less, and the inner diameter $L_2$ of the second spiral blade 203*a* is appropriately set within a range of 5 mm or more and 15 mm or less. In addition, a thickness of $L_3$ of the second spiral blade 203*a* is appropriately set within a range of 1 mm or more and 3 mm or less. In addition, a length $L_4$ of the long side portion of the circumferential rotation plate 203*c* is appropriately set within a range of 20 mm or more and 50 mm or less, and a length $L_5$ of a short side portion of the circumferential rotation plate 203*c* is appropriately set within a range of 5 mm or more and 15 mm or less.

The toner concentration detection sensor 208 is mounted in the bottom of the developer tank 201 on a vertically lower side of the second developer conveying section 203, and is provided so that a sensing surface thereof is exposed to the second conveying path Q. The toner concentration detection sensor 208 is electrically connected to a toner concentration control unit (not shown).

The toner concentration control unit performs control of causing the toner discharge member 303 to rotate according to a toner concentration detection result obtained by the toner concentration detection sensor 208 and supplying the toner to the inside of the developer tank 201. More specifically, the toner concentration control unit determines whether or not toner concentration detection result obtained by the toner concentration detection sensor 208 is lower than a predetermined set value, and sends a control signal to the driving unit that causes the toner discharge member 303 to rotate, thereby causing the toner discharge member 303 to rotate at predetermined cycle when it is determined that the result is lower than the set value.

To the toner concentration detection sensor 208, a power source (not shown) is connected. The power source applies, to the toner concentration detection sensor 208, a driving voltage for driving the toner concentration detection sensor 208 and a control voltage for outputting the toner concentration detection result to the toner concentration control unit. The application of the voltage to the toner concentration detection sensor 208 by the power source is controlled by a control unit (not shown).

As the toner concentration detection sensor 208, a general toner concentration detection sensor is usable, and examples thereof include a transmissive optical detection sensor, a reflective optical detection sensor, and a permeability detection sensor. Among the toner concentration detection sensors, it is preferable to use the permeability detection sensor. Examples of the permeability detection sensor include TS-L (trade name, manufactured by TDK corporation), TS-A (trade name, manufactured by TDK corporation), and TS-K (trade name, manufactured by TDK corporation).

Hereinafter, in the bottom of the developer tank 201, a portion that faces the first conveying path P is referred to as a first conveying path bottom 201*a*, a portion that faces the second conveying path Q is referred to as a second conveying path bottom 201*b*, a portion that faces the first communication path R is referred to as a first communication path bottom 201*c*, and a portion that faces the second communication path S is referred to as a second communication path bottom 201*d*.

The first conveying path bottom 201*a* is formed to be inclined so that a downstream-side portion in the first conveying direction X is located on a vertically upper side in relation to an upstream-side portion in the first conveying direction X. A vertical distance between the downstream-side portion and the upstream-side portion of the first conveying path bottom 201*a* in the first conveying direction X is appropriately set within a range of 10 mm or more and 40 mm or less. The second conveying path bottom 201*b* is formed in a substantially horizontal fashion.

The first communication path bottom 201 is formed to be inclined so that a portion of the first conveying path P side thereof is located on a vertically upper side in relation to a portion of the second conveying path Q side thereof. A vertical distance between the portion of the second conveying path Q side and the portion of the first conveying path P side of the first communication path bottom 201*c* is appropriately set within a range of 5 mm or more and 20 mm or less. The second communication path bottom 201*d* is formed to be inclined so that a portion of the second conveying path Q side thereof is located on a vertically upper side in relation to a portion of the first conveying path P side thereof. A vertical distance between the portion of the first conveying path P side and the portion of the second conveying path Q side of the second communication path bottom 201*d* is appropriately set within a range of 5 μm or more and 20 mm or less.

In addition, in the bottom of the developer tank 201, a portion that faces the upstream-side portion of the first conveying path P in the first conveying direction X is referred to as a first conveying path upstream-side bottom 201*e*, and a portion between the first conveying path upstream-side bottom 201*e* and the first conveying path bottom 201*a* is referred to as a first barrier wall portion 201*f*. The first barrier wall portion 201*f* is adjacent to the first conveying path upstream-side bottom 201*e* on the downstream side in the first conveying direction X in relation to the first conveying path upstream-side bottom 201*e*. In addition, the first barrier wall portion 201*f* is formed to protrude toward a vertically upper side in relation to the first conveying path upstream-side bottom 201*e*. A vertical distance between the first conveying path upstream-side bottom 201*e* and the first barrier wall portion 201*f* is appropriately set within a range of 3 mm or more and 15 mm or less.

In addition, in the bottom of the developer tank 201, a portion that faces the downstream-side portion of the first conveying path P in the first conveying direction X is referred to as a first conveying path downstream-side bottom 201*g*, and a portion between the first conveying path downstream-side bottom 201*g* and the first conveying path bottom 201*a* is referred to as a second barrier wall portion 201*h*. The second barrier wall portion 201*h* is adjacent to the first conveying path downstream-side bottom 201*g* on the upstream side in the first conveying direction X in relation to the first conveying path downstream-side bottom 201*g*. In addition, the second barrier wall portion 201*h* is formed to protrude toward a vertically upper side in relation to the first conveying path downstream-side bottom 201*g*. A vertical distance between the first conveying path downstream-side bottom 201*g* and the second barrier wall portion 201*h* is appropriately set within a range of 3 mm or more and 15 mm or less.

According to the developing device 200 configured as described above, in the developer tank 201, the developer is circulation-conveyed in the order of the first conveying path P, the first communication path R, the second conveying path Q, and the second communication path S. A part of the developer that is circulation-conveyed in this manner is borne on the surface of the developing roller 204 at the second conveying path Q and the toner in the borne developer is moved to the photoreceptor drum 21 and is sequentially consumed. When the toner concentration detection sensor 208 detects that a predetermined amount of toner is consumed, an unused toner is supplied to the first conveying path P from the toner cartridge 300. The supplied toner is diffused in the developer while being conveyed in the first conveying path P.

Figure 9:
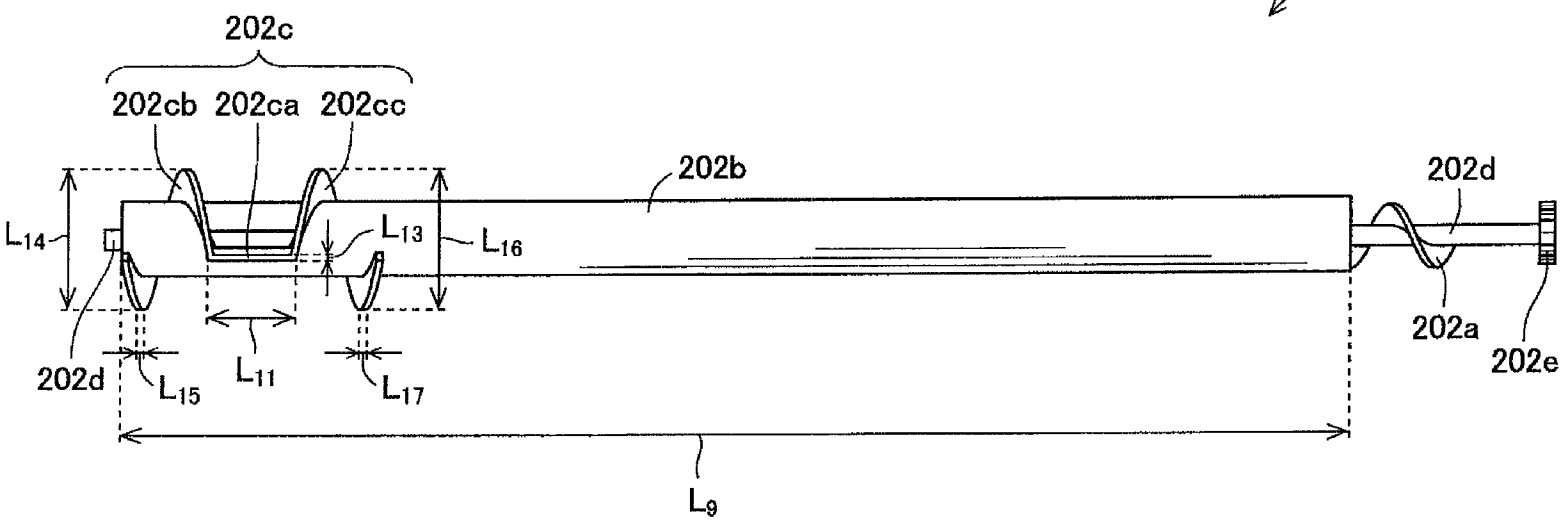
FIG. 9 is a schematic diagram illustrating the entirety of a first developer conveying section.
Figure 10:
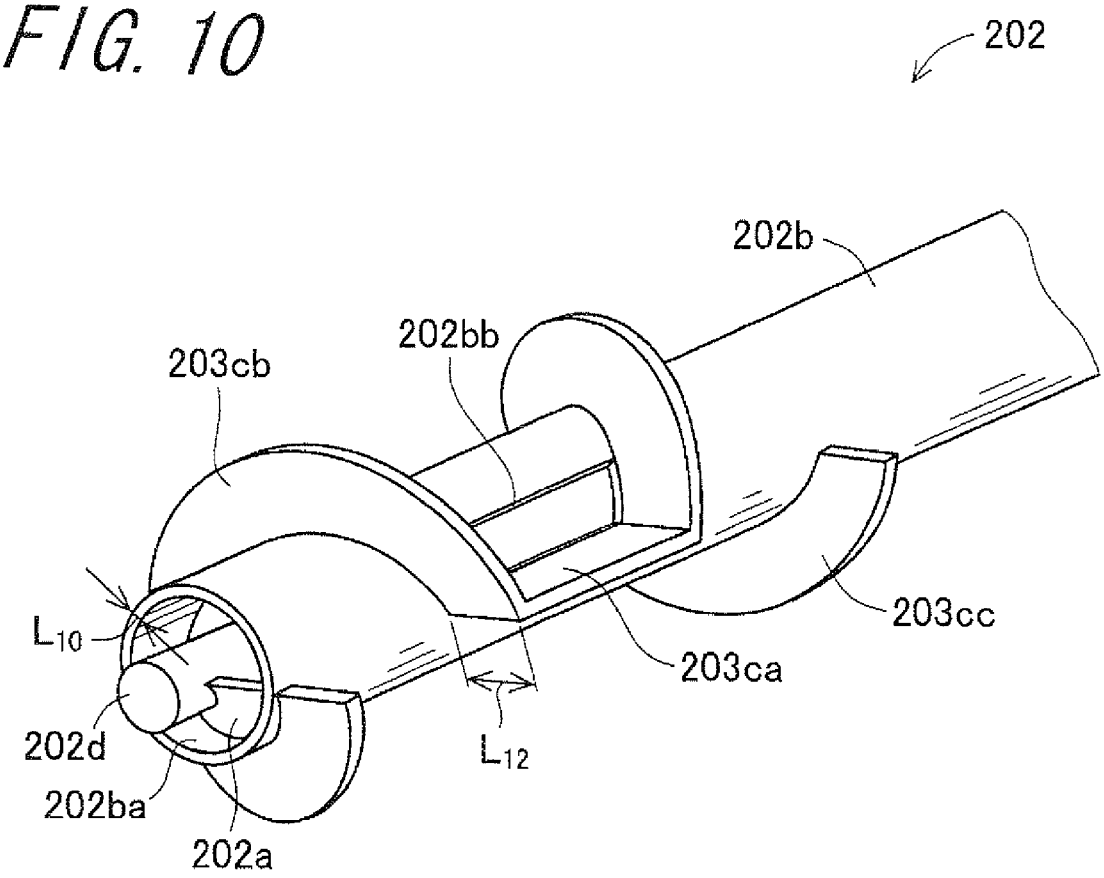
FIG. 10 is a diagram illustrating an upstream-side portion of the first developer conveying section in a first conveying direction X.
Figure 11:
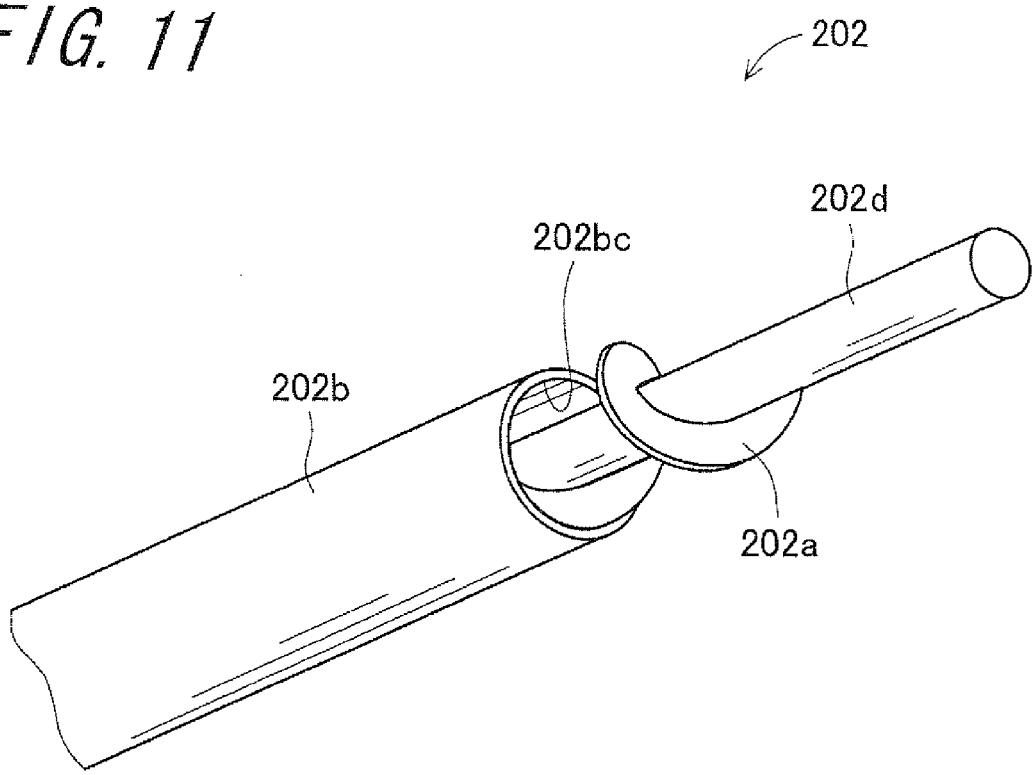
FIG. 11 is a diagram illustrating a downstream-side portion of the first developer conveying section in the first conveying direction X.
Figure 12:
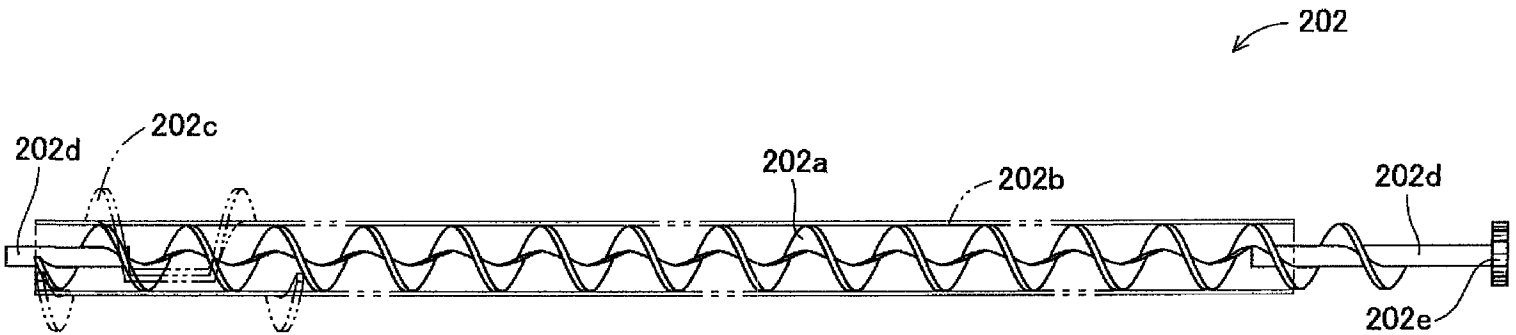
FIG. 12 is a schematic diagram illustrating an internal side of a rotation tube.
Figure 13:
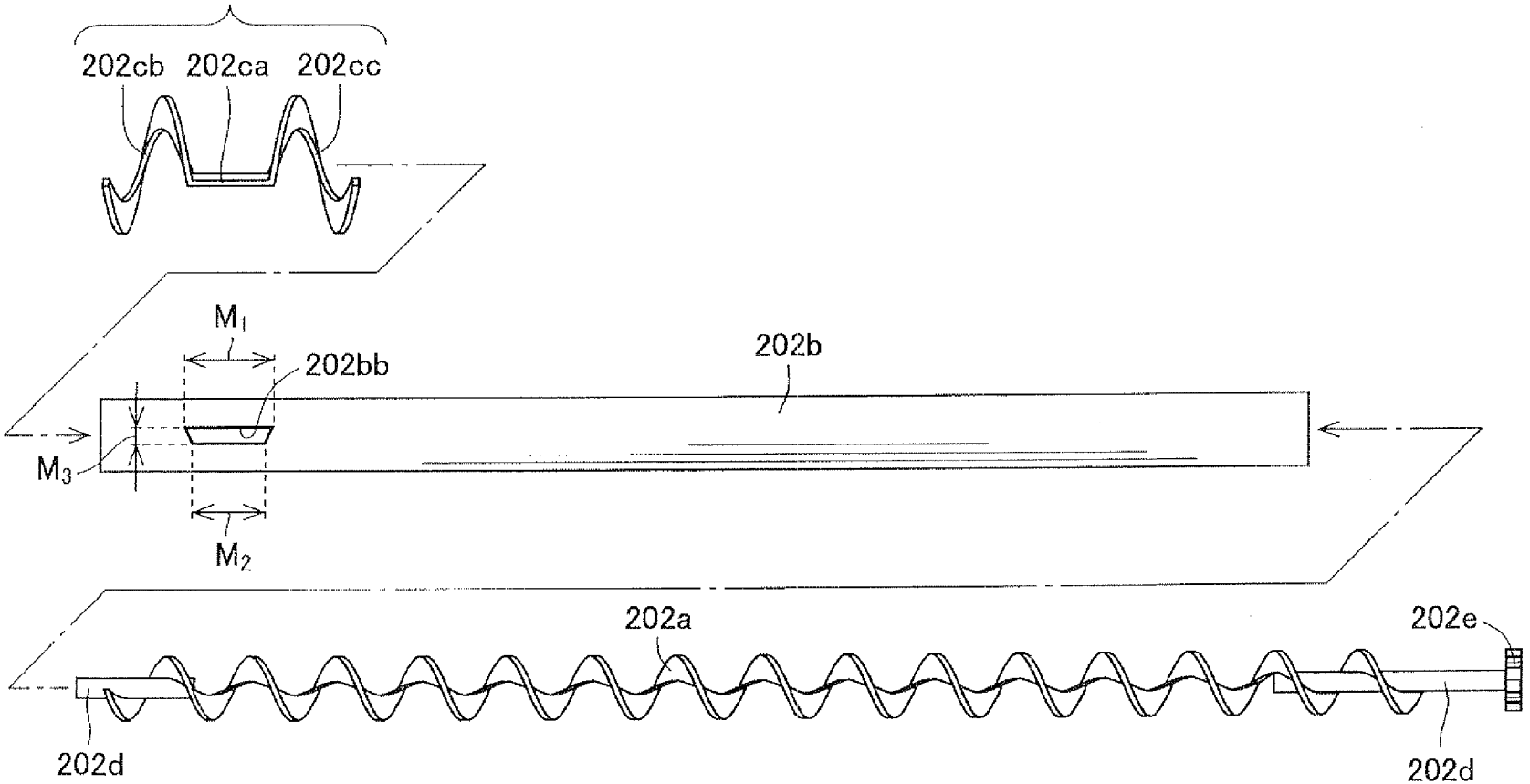
FIG. 13 is an exploded view of the first developer conveying section.

Hereinafter, the first developer conveying section 202 will be described in detail. FIG. 9 is a schematic diagram illustrating the entirety of the first developer conveying section 202. FIG. 10 is a diagram illustrating an upstream-side portion of the first developer conveying section 202 in the first conveying direction X. FIG. 11 is a diagram illustrating a downstream-side portion of the first developer conveying section 202 in the first conveying direction X. FIG. 12 is a schematic diagram illustrating the internal side of the rotation tube 202*b*. FIG. 13 is an exploded view of the first developer conveying section 202. As described above, the first developer conveying section 202 includes the first spiral blade 202*a*, the rotation tube 202*b*, the developer guiding blade 202*c*, the supporting members 202*d*, and the first gear 202*e*.

The first spiral blade 202*a*, the rotation tube 202*b*, the developer guiding blade 202*c*, the supporting members 202*d*, and the first gear 202*e* are formed of a material such as polyethylene, polypropylene, high impact polystyrene, ABS resin (acrylonitrile-butadiene-styrene copolymer synthetic resin), or the like. When the materials of the first spiral blade 202*a*, the rotation tube 202*b*, the developer guiding blade 202*c*, the supporting members 202*d*, and the first gear 202*e* are the same as each other, it is preferable that the first developer conveying section 202 is integrally formed.

The first spiral blade 202*a* is a member having a shape that is spirally wound on the side surface of the imaginary column, and has a substantially annular shape when seen in an axial line direction of the imaginary column. More specifically, the first spiral blade 202*a* is a member with a predetermined thickness, which has a plane made up by a trajectory of a line segment when the line segment is made to move along a spiral. Here, "spiral" is a continuous spatial curve on the side surface of the imaginary column which spatial curve advances in one direction of axial line directions of the imaginary column while advancing in one direction of circumferential directions of the imaginary column. In addition, the axial line of the imaginary column an which the first spiral blade 202*a* is spirally wound extends along the first conveying path bottom 201*a* and is inclined with respect to the horizontal direction.

A value of two times a distance between the axial line of the imaginary column on which the first spiral blade 202*a* is spirally wound and a point, which is farthest from the axial line, on the first spiral blade 202*a* is referred to as an outer diameter $L_6$ of the first spiral blade 202*a*. In addition, a value of two times a distance from the axial line of the imaginary column on which the first spiral blade 202*a* is spirally wound to a point, which is nearest to the axial line, on the first spiral blade 202*a* is referred to as an inner diameter $L_7$ of the first spiral blade 202*a*. The outer diameter $L_6$ is appropriately set within a range of 10 mm or more and 30 mm or less, and the inner diameter $L_7$ is appropriately set within a range of 0 mm or more and 8 mm or less. In addition, a thickness $L_8$ of the first spiral blade 202*a* is appropriately set within a range of 1 mm or more and 3 mm or less.

In regard to the first spiral blade 202*a*, a portion that is farthest from the axial line of the imaginary column on which the first spiral blade 202*a* is spirally wound is referred to as an outer peripheral portion of the first spiral blade 202*a*. In addition, the outer peripheral portion of the first spiral blade 202*a* has a spiral shape. The rotation tube 202*b* is fixed to the outer peripheral portion of the first spiral blade 202*a* so as to surround the outer peripheral portion. The rotation tube 202*b* is fixed to the first spiral blade 202*a*, and therefore the rotation tube 202*b* rotates together with the first spiral blade 202*a*.

According to this embodiment, the rotation tube 202*b* is a cylindrical member extending in the first conveying direction X, and a length $L_9$ of the rotation tube 202*b* in the axial line direction thereof is shorter than a length of the first conveying path P in the first conveying direction X by a length of the first communication path R. The length $L_9$ of the rotation tube 202*b* in the axial line direction thereof is preferably 80% or higher and 95% or lower of the longitudinal length of the first spiral blade 202*a*, and more preferably 85% or higher and 90% or lower. In addition, a thickness $L_{10}$ of the rotation tube 202*b* is appropriately set within a range of 0.5 mm or more and 2 mm or less.

The rotation tube 202*b* has a first inflow opening portion 202*ba* and a second inflow opening portion 202*bb* on an upstream side in the first conveying direction X. In addition, the rotation tube 202*b* has an outflow opening portion 202*bc* on a downstream side in the first conveying direction X.

The first inflow opening portion 202*ba* is provided at one end of the cylindrical rotation tube 202*b* in the axial line direction thereof, and has a substantially circular opening formed to communicate between an internal space and an external space of the rotation tube 202*b*. The developer existing on the external side of the rotation tube 202*b* in the developer tank 201 flows into the internal side of the rotation tube 202*b* through the opening formed at the first inflow opening portion 202*ba*.

The second inflow opening portion 202*bb* is provided in the peripheral wall of the cylindrical rotation tube 202*b*, and has a substantially trapezoidal opening formed to communicate between the internal space and the external space of the rotation tube 202*b*. The substantially trapezoidal opening is formed so that the upper base $M_1$ and the lower base $M_2$ horizontally extend in the axial line direction of the rotation tube 202*b*, and the upper base $M_1$ is appropriately set within a range of 10 to 35 mm, and the lower base $M_2$ is appropriately set within a range of 15 to 40 mm, the height $M_3$ is appropriately set within a range of 5 to 20 mm. The developer existing on the external side of the rotation tube 202*b* in the developer tank 201 flows into the internal side of the rotation tube 202*b* through the opening formed in the second inflow opening 202*bb*. In addition, the opening of the second inflow opening 202*bb* is formed on a vertically lower side of the supply port 205*a* of the developer tank cover 205.

The outflow opening portion 202*bc* is provided at the other end of the cylindrical rotation tube 202*b* in the axial line direction thereof, and has a substantially circular opening formed to communicate between an internal space and an external space of the rotation tube 202*b*. The developer existing on the internal side of the rotation tube 202*b* flows out to the external side of the rotation tube 202*b* through the opening formed at the outflow opening portion 202*bc*.

The developer guiding plate 202*c* is fixed to an outer circumferential wall of the cylindrical rotation tube 202*b* at a position that faces the opening of the second inflow opening portion 202*bb*. The developer guiding blade 202*c* is a member that rotates following rotation of the rotation tube 202*b* and guides the developer existing on the external side of the rotation tube 202*b* to the opening of the second inflow opening portion 202*bb* by rotation thereof.

The developer guiding blade 202*c* includes a vertical blade 202*ca*, a forward spiral blade 202*cb*, and an inverse spiral blade 202*cc*. The vertical blade 202*ca* is a rectangular flat plate-like member, and is fixed in the vicinity of the upstream side of the opening of the second inflow opening portion 202*bb* in the rotational direction $G_1$ so that one side portion of the vertical blade 202*ca* is disposed along the axial line direction of the cylindrical rotation tube 202*b* and the other side portion of the vertical blade 202*ca* is orthogonal to the outer circumferential wall of the cylindrical rotation tube 202*b*. A length $L_{11}$ of one side portion of the vertical blade 202*ca* is set to substantially the same length as that of the opening of the second inflow opening portion 202*bb* in the axial line direction of the rotation tube 202*b*, and a length $L_{12}$ of the other side portion of the vertical blade 202*ca* is appropriately set within a range of 20 mm or more and 50 ram or less. In addition, a thickness $L_{13}$ of the vertical blade 202*ca* is appropriately set within a range of 1 mm or more and 3 mm or less.

The forward spiral blade 202*cb* is connected to the vertical blade 202*ca* on the upstream side in the first conveying direction X, and rotates together with the rotation tube 202*b*, and thereby conveys the developer in the first conveying path P toward the downstream side in the first conveying direction X. The forward spiral blade 202*cb* is a member that has a shape spirally wound on the outer circumferential wall of the cylindrical rotation tube 202*b*, and has a substantially annular shape when seen in the axial line direction of the rotation tube 202*b*. A value of two times a distance from the axial line of the rotation tube 202*b* to a point, which is farthest from the axial line, on the forward spiral blade 202*cb*, that is, an outer diameter $L_{14}$ of the forward spiral blade 202*cb* is appropriately set within a range of 20 mm or more and 50 mm or less. In addition, a thickness $L_{15}$ of the forward spiral blade 202*cb* is appropriately set within a range of 1 mm or more and 3 mm or less.

The inverse spiral blade 202*cc* is connected to the vertical blade 202*ca* on the downstream side in the first conveying direction X, and rotates together with the rotation tube 202*b*, and thereby conveys the developer in the first conveying path P toward the upstream side in the first conveying direction X. The inverse spiral blade 202*cc* is a member that has a shape spirally wound on the outer circumferential wall of the cylindrical rotation tube 202*b*, and has a substantially annular shape when seen in the axial line direction of the rotation tube 202*b*. A value of two times a distance from the axial line of the rotation tube 202*b* to a point, which is farthest from the axial line, on the inverse spiral blade 202*cc*, that is, an outer diameter $L_{16}$ of the inverse spiral blade 202*cc* is appropriately set within a range of 20 mm or more and 50 mm or less. In addition, a thickness $L_{17}$ of the inverse spiral blade 202*cc* is appropriately set within a range of 1 mm or more and 3 mm or less.

According to the first developer conveying section 202 thus configured, the developer in the developer tank 201 flows into the internal side of the rotation tube 202*b* from the first inflow opening portion 202*ba* and the second inflow opening portion 202*bb* of the rotation tube 202*b* on the upstream side in the first conveying direction X, is conveyed toward the downstream side in the first conveying direction X by the first spiral blade 202*a* inside of the rotation tube 202*b*, and flows out to the external side of the rotation tube 202*b* from the outflow opening portion 202*bc* of the rotation tube 202*b*. At this time, the rotation tube 202*b* rotates together with the first spiral blade 202*a*, and by this rotation, friction is generated between the developer conveyed by the first spiral blade 202*a* and the inner circumferential wall of the rotation tube 202*b*, and as a result, the developer is charged. Therefore, the developing device 200 according to the embodiment can sufficiently charge the developer while suppressing stress generated in the developer, and can convey the developer through the inside of the first conveying path P. In addition, when the stress to the developer is increased, an external additive of the toner is embedded in the toner particles. Accordingly, the flowability of the developer is decreased, or the carrier is quickly deteriorated, so that it is difficult to form a good image.

In the case of the two-component developer containing a toner and a carrier, according to the developing device 200 of the embodiment, when being conveyed by the first spiral blade 202*a*, the developer is agitated by the friction between the developer and the inner circumferential wall of the rotation tube 202*b*, and thereby it is possible to sufficiently mix the toner and carrier.

According to this embodiment, at the central portion of the first spiral blade 202*a* in the longitudinal direction thereof, nothing is provided on the internal side of the first spiral blade 202*a*, so that the internal space is used as a moving space of the developer. That is, the developer existing in the internal space of the first spiral blade 202*a* is not pushed by the first spiral blade 202*a*, so that it tends to remain without advancing in the first conveying direction X. As a result, the developer existing in the internal space of the first spiral blade 202*a* appears to advance in a direction reverse to the first conveying direction X when the developer advancing in the first conveying direction X is given as a reference. Therefore, in this embodiment, such two flows of the developer are generated in the first conveying path P, and friction is generated between the developers, and as a result, it is possible to effectively charge the developer. In addition, nothing is provided on the internal side of the first spiral blade 202*a*, so that it is possible to store a relatively large amount of developer in the developer tank 201. In addition, in another embodiment, at the central portion of the first spiral blade 202*a* in the longitudinal direction thereof, a columnar member may be provided on the internal side of the first spiral blade 202*a*.

In addition, in this embodiment, the rotation tube 202*b* has a cylindrical shape, and the second inflow opening portion 202*bb* is provided in the circumferential wall of the cylindrical rotation tube 202*b*. The developer guiding blade 202*c*, which guides the developer existing on the external side of the rotation tube 202*b* to the second inflow opening portion 202*bb* when rotating following rotation of the rotation tube 202*b*, is fixed to the outer circumferential wall of the rotation tube 202*b*. Therefore, in this embodiment, it is possible to smoothly guide the developer to the first spiral blade 202*a* provided inside the rotation tube 202*b*, so that it is possible to suppress stress generated in the developer. In addition, in another embodiment, the developer guiding blade 202*c* may not be provided.

In addition, in this embodiment, the first conveying path bottom 201*a* is formed to be inclined so that the downstream-side portion in the first conveying direction X is located on a vertically upper side in relation to the upstream-side portion in the first conveying direction X. Therefore, the developer on the first conveying path bottom 201*a* tends to move to an upstream side in the first conveying direction X due to the effect of gravity. In this manner, the developing device 200 can suppress the retention of the developer between the first developer conveying section 202 and the bottom of the developer tank 201 at an intermediate position in the first conveying direction X.

In addition, the first communication path bottom 201*c* is formed to be inclined so that the portion of the first conveying path P side thereof is located on a vertically upper side in relation to the portion of the second conveying path Q side thereof. Therefore, the developer on the first communication path bottom 201*c* tends to move to the second conveying path Q side due to the effect of gravity. In this manner, the developing device 200 can suppress the retention of the developer in the first communication path R. In addition, the second communication path bottom 201*d* is formed to be inclined so that the portion of the second conveying path Q side thereof is located on a vertically upper side in relation to the portion of the first conveying path P side thereof. Therefore, the developer on the second communication path bottom 201*d* tends to move to the first conveying path P side due to the effect of gravity. In this manner, the developing device 200 can suppress the retention of the developer in the second communication path S.

As described above, in this embodiment, it is possible to suppress the retention of the developer in the first conveying path P, the first communication path R, and the second communication path S, so that it is possible to smoothly convey the developer. As a result, it is possible to suppress stress generated in the developer. In addition, in another embodiment, the first conveying path bottom 201*a*, the first communication path bottom 201*c*, and the second communication path bottom 201*d* may be formed in a substantially horizontal fashion.

In addition, in this embodiment, the first developer conveying section 202 includes the supporting members 202*d* at both ends in the longitudinal direction of the first spiral blade 202*a*. In this manner, it is possible to drive the first developer conveying section 202 through the supporting member 202*d*, so that a driving mechanism of the developing device 200 may be simplified. In addition, in another embodiment, the first spiral blade 202*a* may be supported without being interposed with the supporting member 202*d*.

In addition, in this embodiment, there is formed the first barrier wall portion 201*f* that is adjacent to the first conveying path upstream-side bottom 201*e* on the downstream side in the first conveying direction X in relation to the first conveying path upstream-side bottom 201*e* and protrudes toward a vertically upper side in relation to the first conveying path upstream-side bottom 201*e*. Therefore, the developing device 200 can suppress the developer from flowing in between the first developer conveying section 202 and the inner wall of the developer tank 201 from the upstream side in the first conveying direction X. In addition, in another embodiment, the first barrier wall portion 201*f* may not be formed.

In addition, in this embodiment, there is formed the second barrier wall portion 201*h* that is adjacent to the first conveying path downstream-side bottom 201*g* on the upstream side in the first conveying direction X in relation to the first conveying path downstream-side bottom 201*g* and protrudes toward a vertically upper side in relation to the first conveying path downstream-side bottom 201*g*. Therefore, the developing device 200 can suppress the developer from flowing in between the first developer conveying section 202 and the inner wall of the developer tank 201 from the downstream side in the first conveying direction X. In addition, in another embodiment, the second barrier wall portion 201*h* may not be formed.

In this embodiment, even though the rotation tube 202*b* has two opening portions of the first inflow opening portion 202*ba* and the second inflow opening section 202*bb* as opening portions through which the developer flows in, in another embodiment, the number of the opening portion through which the developer flows in may be one or three or more. In addition, in this embodiment, even though the rotation tube 202*b* has one outflow opening portion 202*bc* as an opening portion through which the developer flows out, in another embodiment, the number of the opening portion through which the developer flows out may be two or more. In addition, in another embodiment, the circumferential rotation plates may be fixed to the supporting member 202*d* on the downstream side of the first spiral blade 202*a* in the first conveying direction X.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A developing device comprising:

a developer tank that contains developer, the developer tank including a partition, an internal space of the developer tank being partitioned by the partition into a first conveying path extending along a longitudinal direction of the partition, a second conveying path being opposite to the first conveying path with the partition interposed therebetween, a first communication path through which the first conveying path and the second conveying path communicates with each other on a side of one end in the longitudinal direction of the partition, and a second communication path through which the first conveying path and the second conveying path communicates with each other on a side of the other end in the longitudinal direction of the partition;

a first developer conveying section that is disposed in the first developer conveying path and conveys the developer in the developer tank from the side of the other end toward the side of the one end in the longitudinal direction of the partition, the first developer conveying section including:

a spiral blade that is spirally wound on a side surface of an imaginary column and conveys the developer by rotation around an axial line of the imaginary column, a rotation tube that has a cylindrical shape, surrounds an outer peripheral portion of the spiral blade and rotates together with the spiral blade, the rotation tube having an inflow opening portion through which the developer flows in and which is disposed in a circumferential wall of the rotation tube on the side of the other end in the longitudinal direction of the partition, and an outflow opening portion through which the developer flows out and which is disposed on the side of the one end in the longitudinal direction of the partition, and a developer guiding blade that is fixed to an outer circumferential wall of the rotation tube, and guides the developer existing on an external side of the rotation tube to the inflow opening portion by rotation of the rotation tube;

a second developer conveying section that is disposed in the second conveying path and conveys the developer in the developer tank from the side of the one end toward the side of the other end in the longitudinal direction of the partition; and a developing roller that bears the developer and supplies the developer to an image bearing member, the developing roller facing the second conveying path.

2. The developing device of claim 1, wherein the developer tank includes a first conveying path bottom that faces the first conveying path, a first communication path bottom that faces the first communication path, and a second communication path bottom that faces the second communication path, the first conveying path bottom is formed to be inclined so that the side of the one end in the longitudinal direction of the partition is located on a vertically upper side in relation to the side of the other end in the longitudinal direction of the partition, the first communication path bottom is formed to be inclined so that the side of the first conveying path thereof is located on a vertically upper side in relation to the side of the second conveying path thereof, and the second communication path bottom is formed to be inclined so that the side of the second conveying path thereof is located on a vertically upper side in relation to the side of the first conveying path thereof.

3. The developing device of claim 1, wherein the first developer conveying section has columnar supporting members at both ends in the longitudinal direction of the spiral blade.

4. The developing device of claim 1, wherein the developer tank has a first conveying path upstream-side bottom that faces a portion of the first conveying path on the side of the other end in the longitudinal direction of the partition, and a first barrier wall portion that is adjacent to the first conveying path upstream-side bottom on the side of the one end in the longitudinal direction of the partition in relation to the first conveying path upstream-side bottom, and the first barrier wall portion is formed to protrude toward a vertically upper side in relation to the first conveying path upstream-side bottom.

5. The developing device of claim 1, wherein the developer tank has a first conveying path downstream-side bottom that faces a portion of the first conveying path on the side of the one end in the longitudinal direction of the partition, and a second barrier wall portion that is adjacent to the first conveying path downstream-side bottom on the side of the other end in the longitudinal direction of the partition in relation to the first conveying path downstream-side bottom, and the second barrier wall portion is formed to protrude toward a vertically upper side in relation to the first conveying path downstream-side bottom.

6. An electrophotographic image forming apparatus comprising the developing device of claim 1.

* * * * *